US006675715B1

(12) United States Patent
Kölbli

(10) Patent No.: US 6,675,715 B1
(45) Date of Patent: Jan. 13, 2004

(54) ELECTRONIC PROJECTILE FUSE

(75) Inventor: Bertram Kölbli, Frankfurt (DE)

(73) Assignee: Honeywell AG, Offenbach am Main (DE)

( * ) Notice: Subject to any disclaimer, the term of this patent is extended or adjusted under 35 U.S.C. 154(b) by 16 days.

(21) Appl. No.: 09/937,765

(22) PCT Filed: Jan. 11, 2001

(86) PCT No.: PCT/EP01/00264

§ 371 (c)(1),
(2), (4) Date: Jan. 10, 2002

(87) PCT Pub. No.: WO01/57468

PCT Pub. Date: Aug. 9, 2001

(30) Foreign Application Priority Data

Feb. 2, 2000 (DE) ..... 100 04 582

(51) Int. Cl.[7] ..... F23Q 21/00; F23Q 7/02; F42C 11/00; F42C 17/00; F42C 21/00; F42C 15/40

(52) U.S. Cl. ..... 102/206; 102/215; 102/218; 102/262; 89/6

(58) Field of Search ..... 102/206, 215, 102/218, 262, 264, 202.5; 89/6, 6.5

(56) References Cited

U.S. PATENT DOCUMENTS

| | | | | | |
|---|---|---|---|---|---|
| 3,106,160 | A | * | 10/1963 | Harnau et al. | 102/207 |
| 4,586,437 | A | * | 5/1986 | Miki et al. | 102/220 |
| 4,644,864 | A | * | 2/1987 | Komorowski et al. | 102/215 |
| 4,685,396 | A | * | 8/1987 | Birse et al. | 102/206 |
| 4,928,570 | A | * | 5/1990 | Esterlin et al. | 89/6.5 |
| 5,117,756 | A | * | 6/1992 | Goffin, II | 102/217 |
| 5,343,795 | A | * | 9/1994 | Ziemba et al. | 89/6.5 |
| 5,363,765 | A | * | 11/1994 | Aikou et al. | 102/220 |
| 5,473,986 | A | | 12/1995 | Hau | 102/206 |
| 5,497,704 | A | * | 3/1996 | Kurschner et al. | 102/264 |
| 5,602,360 | A | * | 2/1997 | Sakamoto et al. | 102/220 |
| 5,705,766 | A | * | 1/1998 | Farace et al. | 102/215 |
| 5,787,785 | A | | 8/1998 | Muenzel et al. | 89/6.5 |

FOREIGN PATENT DOCUMENTS

| | | | | |
|---|---|---|---|---|
| FR | 2545207 | | 11/1984 | |
| JP | 05099597 | * | 4/1993 | 102/202.5 |

OTHER PUBLICATIONS

MIL–STD–1316D, "Fuze Design, Safety Criteria For", Apr. 9, 1991.

* cited by examiner

*Primary Examiner*—Michael J. Carone
*Assistant Examiner*—H. A. Blackner
(74) *Attorney, Agent, or Firm*—Wenderoth, Lind & Ponack, L.L.P.

(57) ABSTRACT

A device supplies electric energy for projectile detonators without a battery or additional energy generation during flight of the projectile. For operating the projectile detonator in the flight phase, a supply capacitor charged during an inductive programming phase is disposed. The capacitor has a very low leakage current in order to bridge a time in the range of minutes between the programming and the start of the flight phase without significant energy loss. The charging of the supply capacitor takes place through halfwaves, of a programming AC voltage not utilized in the programming and not under load.

10 Claims, 1 Drawing Sheet

ELECTRONIC PROJECTILE FUSE

BACKGROUND OF THE INVENTION

1. Field of the Invention

The present invention relates to an electronic projectile detonator.

2. Description of the Related Art

Modern electronic detonators currently employ for their energy supply either primary cells, or preferably batteries, which are mechanically/chemically activated only through great accelerations which occur when firing a projectile. This has the advantage that detonators thus equipped do not require maintenance with respect to replacement, for example, of an otherwise employed battery-primary cell, since these batteries are entirely passive during their storage and therefore, permit long storage times.

In the case of detonators thus equipped, in general, an operating sequence of a previously programmed detonator function is started through the activation of the battery, i.e., by running up the battery voltage during the mechanical/chemical activation through the launching accelerations.

The activatable batteries employed must therefore be layed out constructionally such that they reliably activate within an entire temperature range even with an extremely small propellant charge during the firing. On the other hand, the batteries must withstand mechanical loading through environmental tests (for example, a 1.5 m drop onto a steel plate) and acceleration during the charging process without activating. Therewith, by necessity, the constructionally required safety margins between activation and nonactivation grow small. In addition, individual faults in the battery, which are generated by defective battery fabrication or material faults, can reduce these safety reserves further.

In addition to the above statements, it also cannot be excluded that such batteries may activate before the shot. Depending on the function and safety layout of the detonator, this can possibly lead to dangerous detonator states during the overflight phase.

Specifically, in the event of use of artillery, one's own troops are also overshot. For that reason, the requirements with respect to safety against too early a projectile breakup (overflight safety) are, in general, very high. Known numbers for the maximum permitted probability of a premature breakup are between $10^{-5}$ and $10^{-6}$.

On the other hand, due to the above described necessary small constructional gap between function and nonfunction of an acceleration-activatable battery (1.5 m drop no, smallest charging: yes) function problems must also be anticipated with small charging and can also be observed in practice.

In addition, the production of such special batteries due to today's increasing corporate mergers has become concentrated on increasingly fewer companies such that the supply situation, not least through export restrictions of some countries for such products, is becoming increasingly more difficult. If, however, batteries are available, then, in general, only at prices which are often incompatible with the "low-cost product" detonator.

Other known methods of energy generation during the flight of a projectile are generators, installed in the detonator, which generate electric energy for electronics, either by piezo effect or electrodynamically by projectile acceleration, spin build-up or oncoming airstream. However, such solutions are, for example, for an artillery detonator, either not suitable due to the low energy yield (piezo) or even more expensive and more unreliable than a built-in battery. Furthermore, such solutions can only be obtained either as a special fabrication as a product of a long and expensive development phase or, with at least similar difficulty, as an acceleration-activatable battery.

SUMMARY OF THE INVENTION

Building on this prior art, it is therefore the task of the present invention to specify a new projectile detonator, specifically an artillery projectile detonator, which can operate without a battery or additional energy generation during the projectile flight.

It is proposed to employ a capacitor charged during the programming phase for operating the projectile detonator in the flight phase, the capacitor having a very low leakage current in order to be able to bridge a time in the range of minutes between the programming and the start of the flight phase, without significant energy loss.

DETAILED DESCRIPTION OF THE INVENTION

Figure 1:
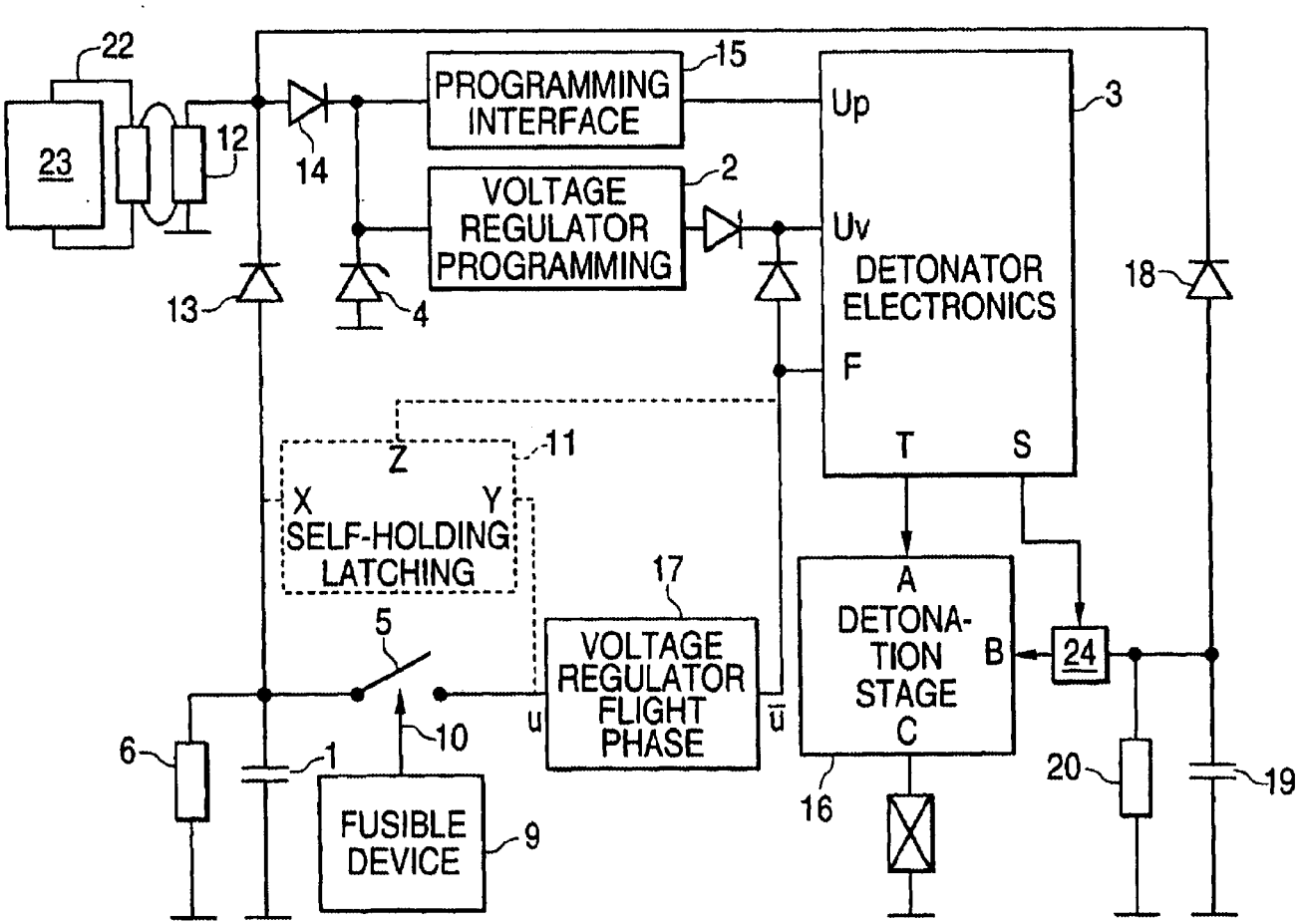
FIG. 1 illustrates a projectile detonator according to the invention.

It is known to transmit programming information during an inductive programming phase via a programming coil 12 internal to a detonator through a transmitting coil 22 of a programming device 23 external to the detonator via a magnetic coupling of the two coils and a modulated magnetic AC field. It is further known to utilize energy transmitted in the programming process for the supply of the detonator during the programming process and, since after the programming process the energy transmission is interrupted through the programming device 23, to store the information transmitted during the programming process such that it is nonvolatile, for example, in an electrically-erasable programmable read-only memory (EEPROM), in the detonator electronics.

In order to be able to comprehend the inventive concept, first the above stated programming process will be discussed in further detail.

In NATO Standardization Agreement (STANAG) 4369 with the associated Allied Ordinance Publication 22 (AOP22), switching proposals for external circuitry of the inductive programming interface are proposed, which in this way or in a similar form are realized in every detonator which must fulfill the demand for compatibility. This external circuitry is also roughly indicated in FIG. 1 through elements 22, 12, 14, 4, 15 and 2. Upon closer inspection of only these few elements, it is apparent that the AC voltage induced in coil 12 through the programming coil 22 is one-way rectified across a diode 14, and through a programming interface 15, and a voltage regulator 2 is loaded with a connected load. In addition, this voltage is limited with respect to amplitude by a Zener diode 4 in order to protect the components of elements 2 and 15 against overvoltage. Through the one-way rectification via the diode 14, however, only the positive halfwave of the AC voltage, present at the junction point of the components 12, 14, 13 and 18, is loaded such that the positive halfwave at this point virtually never exceeds the Zener voltage of the Zener diode 4 plus the forward voltage of the diode 14.

If first the diodes 13 and 18 of FIG. 1 are considered not to be present, at the output of coil 12, the negative halfwaves can assume a voltage amplitude of 50 to 60 V. The energy inherent in these halfwaves, is not used up to this point. If, into the circuit of the FIG. 1, the high-blocking diodes 13 and 18 are again inserted , through the one-way rectification of the negative halfwaves of the output of coil 12, a supply capacitor 1 for the detonator electronics and a supply capacitor 19 for the detonation stage are charged. Very high-ohmic resistors 6 and 20 connected in parallel with the capacitors serve for the defined discharge of the capacitors in the event of a discharge that has not occurred of the detonator and virtually do not load the charging process. This means that both capacitors are charged to a DC voltage of up to an amplitude between −50 and −60 V.

If the capacitance and the voltage of the capacitor 1 are defined as $C_1$ and $U_1$ and as $C_{19}$ or $U_{19}$ as the corresponding values of capacitor 19, then, after the programming for the supply of a voltage regulator 17 and of the detonator electronics 3, the energy $0.5\ C_1\ U_1^2$ is available and for the supply of the detonation stage the energy $0.5\ C_{19}\ U_{19}^2$.

Since the voltage enters as a square into the amplitude of the energy stored during the programming process in the capacitors, but the constructional size and the price of the capacitors increases only proportional to product C U, by utilizing the high negative halfwaves of the programming process, energy can be cost-effectively stored in the detonator in a small space.

The flight phase is subsequently preferably initiated very simply through a (for the blocking phase during the programming and the time before the shot) switch 5 which can be very simply layed out high-ohmically, which connects the inverting switching voltage regulator 17 (inverts u to $\bar{u}$) with the capacitor 1. The switch 5 is actuated in general, through a, specially developed fusible device 9 and hardened against environmental effects so as to be highly reliable upon the occurrence of the environmental forces typical for a shot through an actuation element 10 such that an unintentional closing of switch 5 before the shot proper can virtually only occur with the minute probabilities of $10^{-7}$ to $10^{-8}$ customary with those occurring with mechanical safety devices. If the detonator is not programmed, it is entirely energy-free, which makes it even safer compared to detonators with built-in batteries.

If the switch 5 is constructionally layed out such that after the occurrence of the typical projectile acceleration it closes and, for example, also remains closed through mechanical latching even during the entire flight phase, the electronic self-holding latching, shown in dotted lines in FIG. 1, becomes superfluous. If this cannot be ensured, the self-holding latching 11 ensures that during the occurrence of a voltage at point Z, input X is electrically connected with output Y, and also remains connected as long as the voltage regulator 17 operates.

Detection of the two operating modes programming/flight takes place via two inputs $U_1$, and F of the detonator electronics. If at $U_P$ voltage is present and not at F, the switch 5 is still open and the electronics detects upon the occurrence of UV the presence of programming and processes the corresponding programming sequences at port $U_P$. However, if switch 5 is closed, a voltage is present at input F (and at input $U_P$ no programming sequence) and the electronics works down its programmed flight program.

The switching voltage regulator 17 must have a high efficiency as well as a very large input voltage range in order to avoid unnecessary energy losses. It is, therefore, preferably specifically developed for these or similar applications and, due to the smaller, and therefore, current-saving structures, integrated into an ASIC.

The storage capacitors 1 and 19, also for reasons of low loss, must preferably be foil or ceramic capacitors with minimum leakage current, since their charge must be available in the flight phase as much as possible unchanged even 10 to 20 minutes after the programming.

The supply capacitor 19 for the detonation stage 16 is, as already described, charged in parallel to the supply capacitor 1 during the programming phase. This configuration is necessary since the capacitor 1 during the supply of the detonator electronics 3 is being discharged and for that reason, a satisfactory detonation voltage amplitude with a possible joint supply of the detonation stage 16 from the capacitor 1 could not be ensured.

Shortly before the detonation of the detonation stage 16 through the detonation trigger signal at output T of the detonator electronics 3, via a signal S of the detonator electronics 3 and a suitable electronic switch 24, the capacitor 19 is connected with the detonation stage 16 and the latter is only supplied with energy at this late point in time. Thereby, in spite of early charging of the capacitor 19 in the programming phase, a high overflight safety of the detonator is attained.

The configuration according to FIG. 1 has a further advantage. During the programming through the detonator electronics 3, apart from the programming input $U_P$, the input F is also queried. If the switch is open, i.e., if the fusible device is in the safety position, no voltage is present at F and the programming can be carried out as intended. However, if during the programming process switch 5 is closed, i.e., if the fusible device is primed, the voltage of the capacitor 1 charging during the programming, after conversion by the voltage regulator 17, is impressed on the input F of the detonator electronics 3. The programming function is suppressed with the simultaneous detection of this voltage in connection with a programming sequence at $U_P$. Since the programming, in general, takes place bidirectionally, in this case this dangerous state of the fusible device can also be reported back to the programming equipment, and thus to the operator, and consequently provide a reference for further handling of the detonator.

Thereby requirement 4.6.6 of the detonator safety standard MIL-STD 1316 D can be elegantly fulfilled, which requires an external checking capability of the safety state of the fusible device before installing the detonator into the ammunition. This checking can thereby be carried out via an already present interface, the programming interface, and thus requires no additional expensive measures such as a viewing window or break-throughs on the detonator housing.

What is claimed is:

1. A method for supplying electric energy to a projectile detonator without a battery or additional energy generation during a flight of a projectile, said method comprising charging a supply capacitor located in the projectile during an inductive programming phase for operating the projectile detonator in a flight phase, the supply capacitor having a very low leakage current, wherein said charging of the supply capacitor is performed with half-waves of a programming AC voltage not utilized during the inductive programming phase and not under load.

2. A method as claimed in claim 1, further comprising actuating a switch through a mechanical fusible device, wherein said actuating of the switch supplies the charge of the supply capacitor to a voltage regulator with a large input voltage range and high efficiency.

3. A method as claimed in claim 2, wherein the voltage regulator is operable to invert an input voltage.

4. A method as claimed in claim 1, further comprising actuating a switch through a fusible device, the switch supplying the charge of the supply capacitor to the projectile detonator, and the switch being bridged by a self-holding latching circuit.

5. A method as claimed in claim 1, wherein the supply capacitor is parallel to a detonator capacitor for driving a detonation stage.

6. A method as claimed in claim 5, further comprising placing a charge of the detonator capacitor onto the detonation stage via an electronic switch actuated by detonator electronics.

7. A method as claimed in claim 2, further comprising:

querying an output of the voltage regulator for the flight phase by detonator electronics during the inductive programming phase of the detonator; and deactivating a programming function, if the switch at an input of the voltage regulator does not have a correct switch position.

8. A method as claimed in claim 7, further comprising indicating an incorrect switch position to an operator via a report-back channel of the programming function.

9. A method as claimed in claim 1, further comprising:

switching the programming AC voltage across a diode poled in a first direction to a programming interface and a programming voltage regulator; and charging the supply capacitor and a detonator capacitor across a plurality of diodes poled oppositely from the programming AC voltage.

10. A method as claimed in claim 9, wherein the supply capacitor and the detonator capacitor are connected in parallel with a first resistor and a second resistor, respectively.

* * * * *